US007653998B1

(12) United States Patent
Lambert et al.

(10) Patent No.: US 7,653,998 B1
(45) Date of Patent: Feb. 2, 2010

(54) WOUND PROCESS ELEMENT AND METHOD OF PRODUCTION

(75) Inventors: Donald C. Lambert, Tulsa, OK (US); John W. Sartain, Broken Arrow, OK (US); Nicholas J. Huff, Sand Springs, OK (US)

(73) Assignee: Miratech Corporation, Tulsa, OK (US)

( * ) Notice: Subject to any disclaimer, the term of this patent is extended or adjusted under 35 U.S.C. 154(b) by 762 days.

(21) Appl. No.: 11/226,754

(22) Filed: Sep. 14, 2005

(51) Int. Cl.
*B23P 15/26* (2006.01)

(52) U.S. Cl. ..... 29/890.043; 29/890; 29/890.036; 422/177; 422/180

(58) Field of Classification Search ..... 29/890, 29/890.043, 890.036; 422/180, 179, 177
See application file for complete search history.

(56) References Cited

U.S. PATENT DOCUMENTS

| | | | | |
|---|---|---|---|---|
| 4,282,186 | A | 8/1981 | Nonnenmann et al. | |
| 4,382,323 | A | 5/1983 | Chapman et al. | |
| 4,400,860 | A | 8/1983 | Nonnenmann et al. | |
| 4,448,754 | A | 5/1984 | Isogai et al. | |
| 4,519,120 | A | 5/1985 | Nonnemann et al. | |
| 5,436,216 | A | 7/1995 | Toyao et al. | |
| 5,648,176 | A | 7/1997 | Nakagawa et al. | |
| 5,737,839 | A | 4/1998 | Whittenberger et al. | |
| 5,787,584 | A | 8/1998 | Shea et al. | |
| 5,829,132 | A | 11/1998 | Sickels et al. | |
| 5,866,077 | A | 2/1999 | Sakurai et al. | |
| 5,996,228 | A | 12/1999 | Shoji et al. | |
| 6,217,832 | B1 | 4/2001 | Betta et al. | |
| 6,613,296 | B1 | 9/2003 | Myers et al. | |
| 6,673,320 | B1 | 1/2004 | Tosa et al. | |
| 7,404,254 | B2 * | 7/2008 | Kurth et al. | 29/890 |
| 2005/0002836 | A1 | 1/2005 | Hardesty et al. | |

* cited by examiner

*Primary Examiner*—Rick K Chang
(74) *Attorney, Agent, or Firm*—Fellers, Snider, Blankenship, Bailey & Tippens, P.C.; Dennis D. Brown

(57) ABSTRACT

A wound process element and method of assembly wherein at least one dimpling element is positioned between the outer perimeter of a wound element strip and an outer holding band.

10 Claims, 3 Drawing Sheets

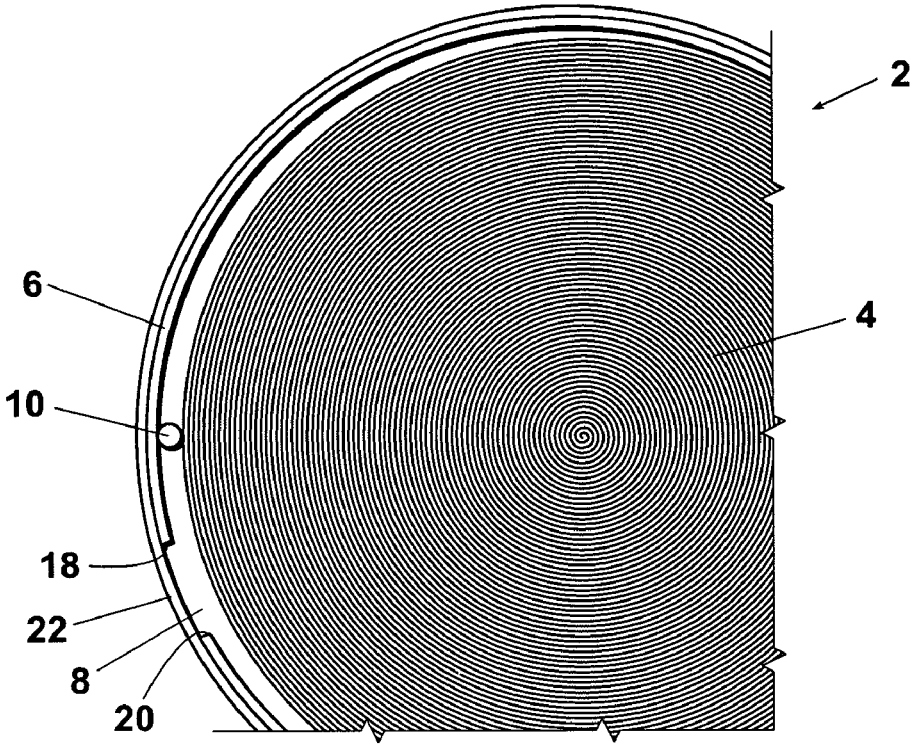
*Fig. 1*
*Fig. 2*
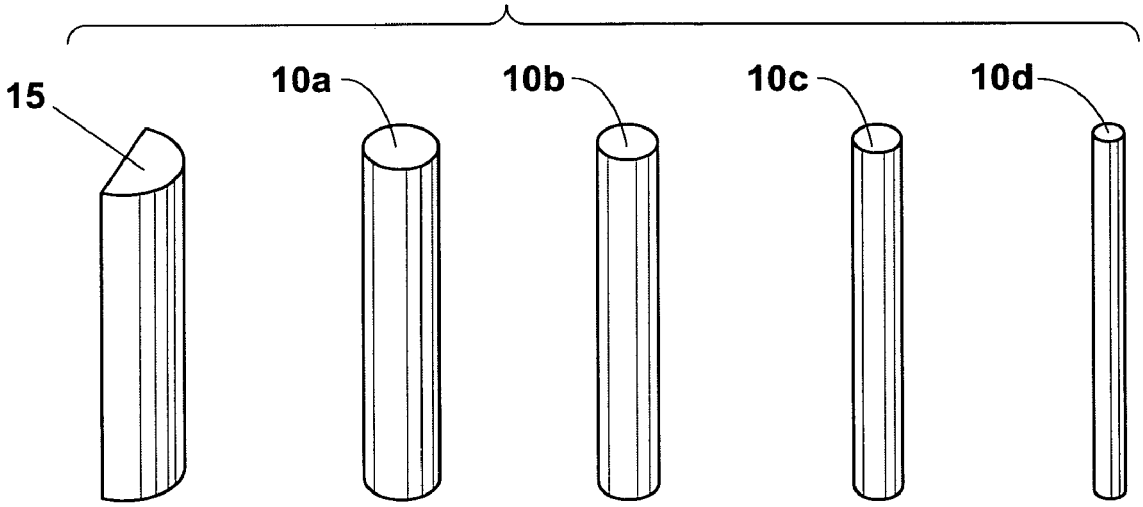

WOUND PROCESS ELEMENT AND METHOD OF PRODUCTION

FIELD OF THE INVENTION

The present invention relates to improved process elements which utilize wound process element strips and to methods of assembling such process elements. More particularly, but not by way of limitation, the present invention relates to improved industrial catalytic converter elements having wound catalyst strip elements and to methods of assembling such catalytic converter elements.

BACKGROUND OF THE INVENTION

Catalytic converter assemblies currently used in the art for controlling emissions from industrial engines typically comprise a converter housing which is installed in the engine exhaust system and at least one catalytic element which is inserted into the converter housing. The catalytic element will typically comprise a wound strip of substrate material (preferably comprising alternating layers of flat and corrugated metal foil) which is impregnated (e.g., by chemisorption impregnation) with, or which otherwise carries, the converter reaction catalyst. The catalytic strip will commonly be wound in a circular pattern and will be held by a metal band which tightly surrounds the outer perimeter of the wound strip.

The wound catalytic converter elements heretofore used in the art have typically been formed by: (a) winding the catalytic element strip in a circular pattern to a desired diameter (typically at least 1.5 feet); (b) placing an appropriately sized, open metal holding band around the outer perimeter of the wound element strip; (c) pulling the holding band tight around the wound catalyst element using a ratchet strap or similar device such that the two ends of the open band meet; and then (d) welding the ends of the holding band together so that the band tightly encircles and holds the wound element strip.

In addition to catalytic converters, wound process elements are also commonly used in flame arrestors, air filters, heat exchangers, and other applications. In addition to metal substrates, examples of other types of substrate materials commonly used in such applications include, but are not limited to, plastics, paper filter media, and cloth filter media.

Wound substrates are typically used in catalytic converters and other applications in order to provide a high ratio of contact surface area to process gas flow. In extreme applications such as those encountered, for example, in the exhaust system of a continuous-duty reciprocating engine, the wound substrate must be of a strength, durability, and integrity to withstand continuous exposure to excessive temperatures and extreme pulsation and vibration, as well as significant variations and changes in the composition of the process gas.

Unfortunately, despite focused efforts in the industry on precision manufacturing, even the best wound substrate elements produced heretofore have been prone to looseness, sagging, and buckling of the element windings, and/or dimpling in the perimeter windings of the substrate—all of which degrade performance and reduce the useful life of the element.

Heretofore, it has not been possible to relieve minor inconsistencies in the shape, winding tension, and other features of a wound element until the "break-in" period where the new wound element is initially placed in actual operation and is exposed to the elevated temperature, vibration, and other harsh conditions of the operating environment. Depending on how the wound element is constrained, the relieved inconsistencies produced during break-in are sometimes distributed throughout the wound element, thus creating an overall looseness in the substrate. Loose substrate materials tend to vibrate excessively in the process flow, thus yielding fatigue failures and large holes or openings within the substrate over time. If, on the other hand, the relieved inconsistencies in the wound substrate are more concentrated, buckles, dimples, and/or gaps will be formed which will allow a significant amount of process gas to simply flow through the process element without contacting the wound substrate.

Predicting the eventual locations of dimples, buckles, gaps, and looseness in wound process elements has been extremely difficult, if not impossible. The imperfections which appear when relieved during the break-in period typically cause a rapid degradation of the element performance and can result in emissions exceedances, penalties for emissions violations, significant down time, and significantly higher costs for maintenance and operation.

SUMMARY OF THE INVENTION

The present invention provides an improved wound process element and method of assembling the improved element which alleviate the problems discussed above. In accordance with the present invention, an arched dimple is intentionally formed in the perimeter region of the wound substrate in a controlled manner at a predetermined location. The end result is a tight substrate which does not break down, loosen, dimple, sag, or buckle during break-in. The inventive manufacturing process is quick, simple, and can be performed using readily available tools and materials. In addition, the inventive method can be used for producing new process elements, for repairing existing elements, or for reclamation of old process elements.

In one aspect, there is provided an improved process element including a wound element strip having an outer perimeter and a holding band secured around the outer perimeter of the wound element strip. The improvement comprises at least one dimpling element positioned between the holding band and the wound element strip.

In another aspect, there is provided a method of assembling a process element including a wound element strip having an outer perimeter. The method comprises the steps of: (a) positioning a holding band around the outer perimeter of the wound element strip, the holding band having a first end and a second end; (b) positioning at least one dimpling element between the holding band and the outer perimeter of the wound element strip; (c) tightening the holding band around the wound element strip and the dimpling element; and (d) securing the first end of the holding band to the second end of the holding band.

Further aspects, features, and advantages of the present invention will be apparent to those in the art upon examining the accompanying drawings and upon reading the following detailed description of the preferred embodiments.

BRIEF DESCRIPTION OF THE DRAWINGS

FIG. 1 is a plan view showing a dimpling element 10 being installed in accordance with the present invention between a wound element strip 4 and an outer holding band 6.

FIG. 2 is a perspective view of examples of different sizes and shapes of dimpling elements 10 *a, b, c*, and *d* and 15 which can be used in the present invention.

DETAILED DESCRIPTION OF THE PREFERRED EMBODIMENTS

Figure 3:
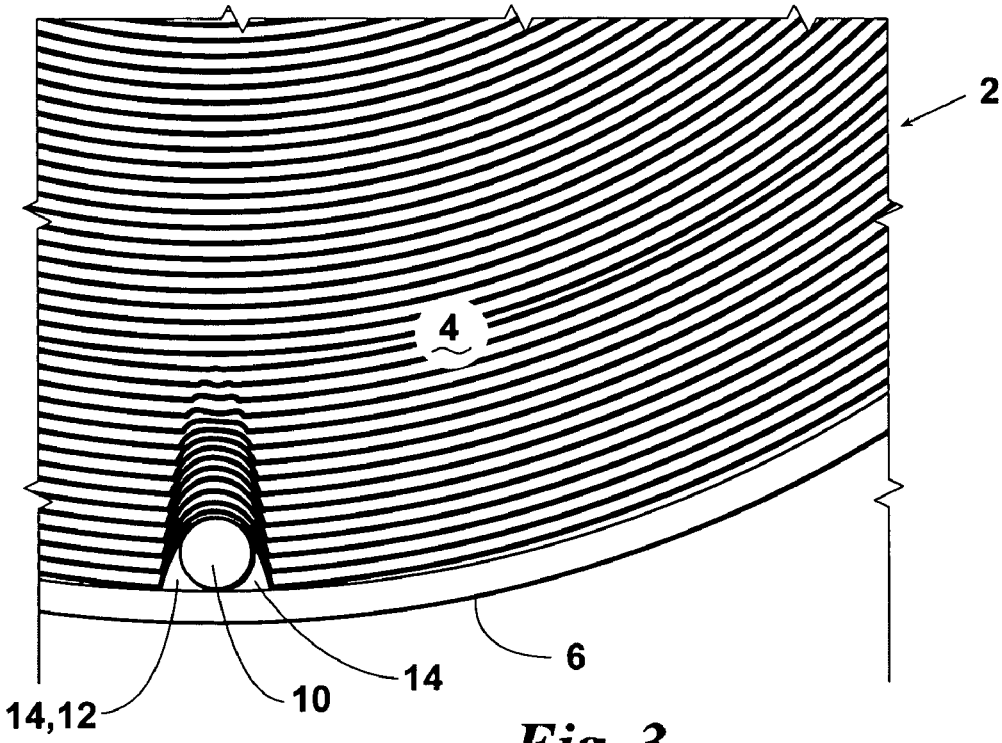
FIG. 3 is a partial plan view of an embodiment 2 of the inventive improved process element constructed using only a single cylindrical dimpling element 10.
Figure 6:
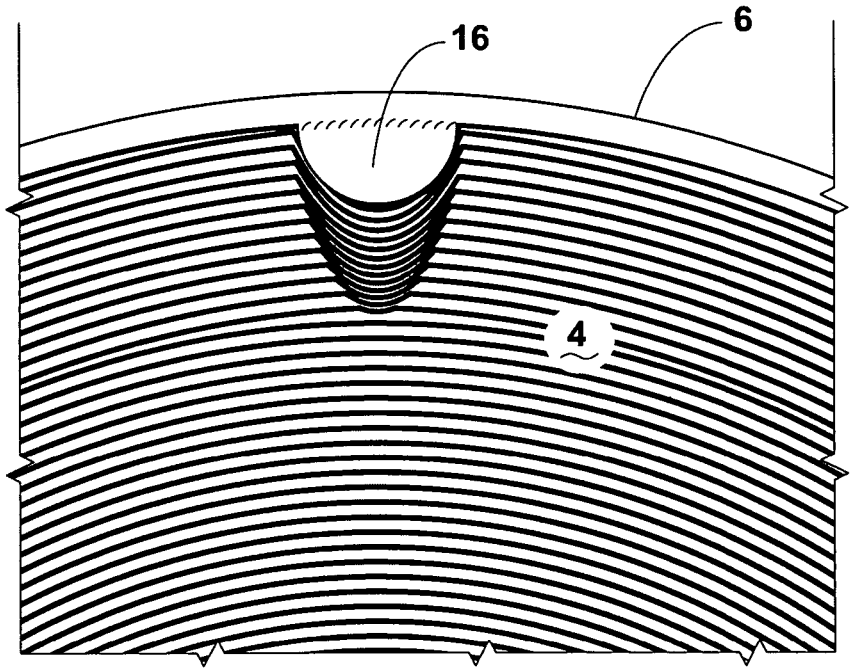
FIG. 6 is a partial plan view of the inventive improved process element having a cover plate 16 attached over the dimpling element(s) 10.

An embodiment 2 of the inventive improved process element and an embodiment of the inventive method for producing the process element 2 are illustrated in FIGS. 1, 3, and 6. The inventive process element 2 is a catalytic converter element comprising: a wound strip 4 of catalyst impregnated, corrugated metal foil; a holding band 6, preferably a metal holding band, which tightly surrounds the outer perimeter 8 of the wound element strip 4; and one or more dimpling elements 10 which is/are tightly held between the holding band 6 and the wound element 4 in a manner effective for intentionally inducing a dimple 12, preferably an arched dimple, in the perimeter 8 of the wound element 4. Although the embodiment 2 of the process element shown in the FIGS. 1, 3, and 6 is a wound element for a catalytic converter assembly, it will be understood by those in the art that the inventive process element can alternatively be a wound element for use in a flame arrestor, an air filter, a heat exchanger, or any other desired process application.

The one or more dimpling elements 10 employed in the present invention can be of any size, shape, and arrangement effective for producing any desired size and shape of dimple 12 in the wound element 4. Examples of different sizes and shapes of dimpling elements 10 *a, b, c*, and *d* and 15 are shown in FIG. 2. The dimpling elements used for producing the inventive process elements will preferably be cylindrical or D-shaped elements having a length which is substantially equal to the width of the wound element strip 4 and holding band 6. If an arrangement of two or more dimpling elements is used, the dimpling elements can be of the same or different shape, size, or diameter. In addition, each dimpling element can be solid or hollow or can be an open member as might be produced, for example, by cutting a section of pipe longitudinally to produce a C-shaped cross-section. However, regardless of the type(s) of dimpling element(s) used, each element should have sufficient inherent strength or be sufficiently reinforced to withstand the force exerted on the element when it is compressed between the holding band 6 and the wound element strip 4.

By way of example, the use of a single dimpling element 10 in accordance with the present invention is illustrated in FIGS. 1 and 3. As another example, an embodiment 30 of the inventive process element produced using a single solid D-shaped dimpling element 15 is illustrated in FIG. 5. As yet another example, an embodiment 25 of the inventive process element produced using a triangular arrangement of three cylindrical dimpling elements 10 is illustrated in FIG. 4.

Figure 4:
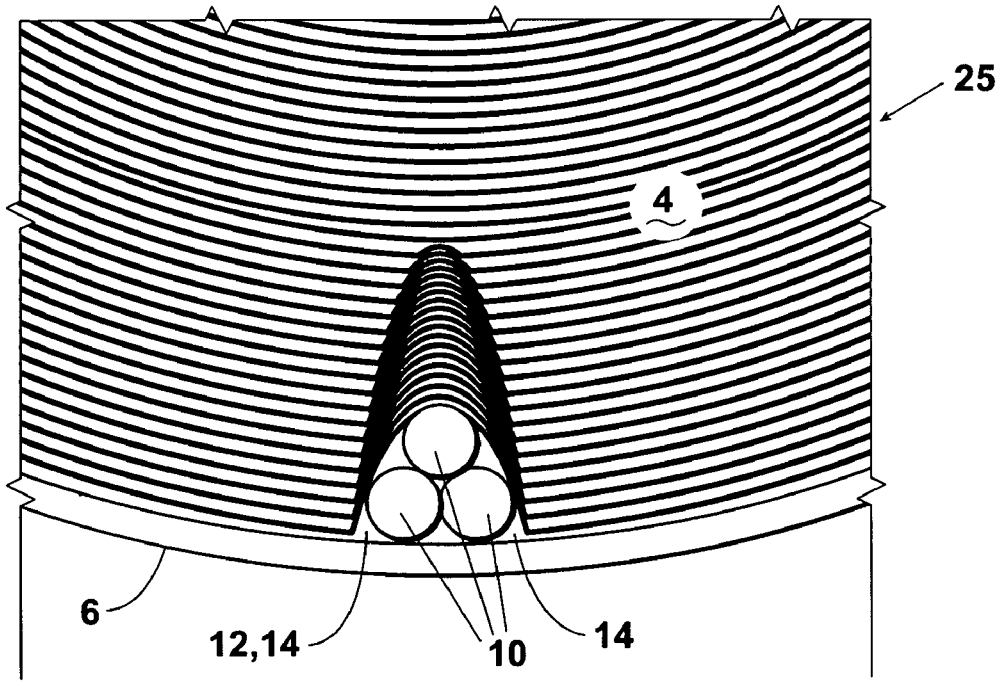
FIG. 4 is a partial plan view of an embodiment 25 of the inventive improved process element constructed using three cylindrical dimpling elements 10 arranged in a triangular pattern.
Figure 5:
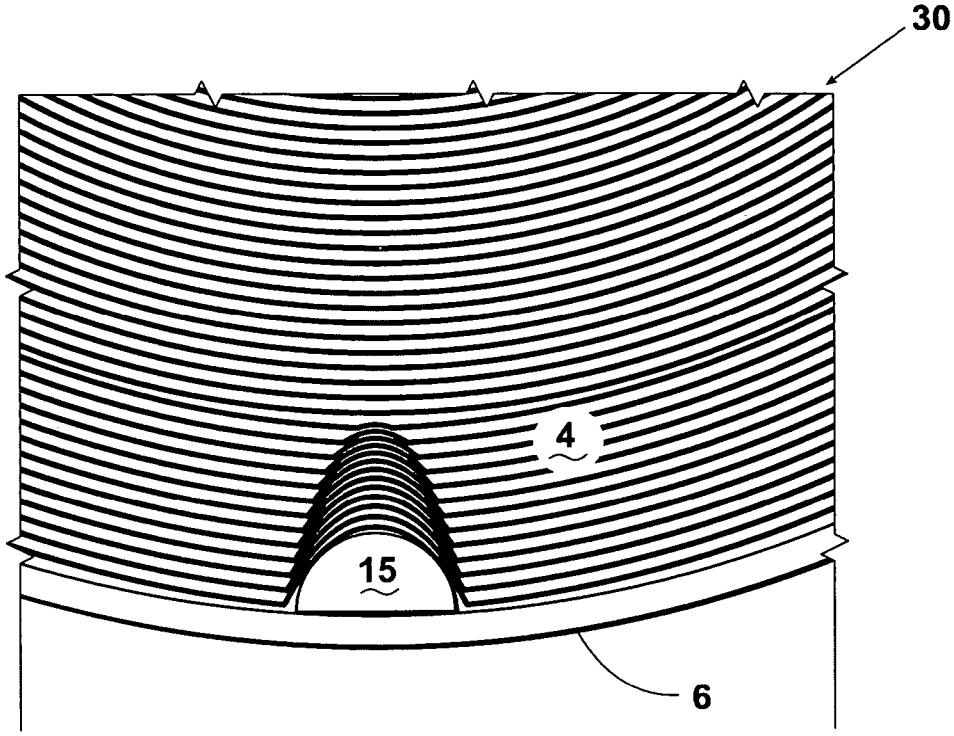
FIG. 5 is a partial plan view of an embodiment 30 of the inventive improved process element produced using a single semi-circular or D-shaped dimpling element 15.

As further illustrated in FIGS. 3 and 4, the use of one or more dimpling elements 10 having cylindrical, hollow, and/or other shapes or configurations may result in the formation of gaps 14 between the wound element strip 4 and the holding band 6. In such cases, the inventive process element preferably further comprises cover plates 16 which are secured on each side of the process element over the ends of the dimpling element(s) 10. Each cover plate 16 is preferably sized and shaped in a manner effective for closing the gaps 14 and thus preventing any process gas from flowing between the holding band 6 and the wound process element 4.

In a preferred embodiment of the inventive method for producing the inventive improved process element, the process element strip 4 will preferably first be wound to a desired diameter in the same manner as heretofore used in the art. Next, the holding band 6 is preferably placed in open position around the outer perimeter 8 of the wound element strip 4. The desired dimpling element(s) 10 and/or 15 used for producing the inventive process element is/are placed between the holding band 6 and wound element 4. The dimpling element(s) 10 and/or 15 is/are preferably positioned within from about 0.5 to about 3 inches, more preferably from about 1 to about 2 inches, from either end 18 or end 20 of the holding band 6.

With the holding band 6 and the dimpling element(s) 10 and/or 15 in place, the holding band 6 is tightened around the wound element 4 and dimpling element(s) 10 and/or 15 using a ratchet strap 22 or any other suitable device. While tightening, the holding band 6 will preferably be tapped around the perimeter thereof with a rubber mallet or similar device in order to help relieve any compression stress, shear stress, and/or other stresses and to assist in causing any looseness in the wound element 4 to migrate toward the induced dimple area 12. As the ends 18 and 20 of the holding band 6 begin to approach within about 1 inch of each other, the exterior of the holding band 6 will preferably be tapped directly over the dimpling element(s) 10 and/or 15 in order to assist in inducing the dimple 12 in the perimeter 18 of the wound element 4.

If, during tightening, an end 18 or 20 of the holding band seats against and begins to drag or snag the outer winding of the wound element strip 4, a screw driver or similar device can be inserted between the dimpling element(s) 10 and the holding band 6 and used to pry the end 18 or 20 of the band away from the wound element 4. In addition, as the ends 18 and 20 of the holding band 6 approach each other, a screw driver or similar device can be inserted and used to adjust the positioning of the dimpling element(s) 10 and/or 15 or to assist in moving multiple dimpling elements 10 and/or 15 to a final desired triangular or other configuration.

When the tightening step is complete, the ends 18 and 20 of the holding band 6 are welded together or otherwise connected. In addition, the ends of each dimple element 10 or 15 adjacent to the holding band 6 are preferably spot-welded to the band, and, if multiple dimpling elements 10 are used, the ends of the dimpling elements 10 can also be spot-welded to each other. If cover plates 16 are needed to cover any gaps 14 around the dimpling element(s) 10, the cover plates 16 are preferably drilled before being placed over the outer ends of the dimpling element(s) 10 so that the cover plates 16 can be spot-welded to the ends of the dimpling element(s) 10. The outer edge of each cover plate 16 will also preferably be seam welded to the holding band 6. Finally, all of the welds are preferably ground smooth so that they will not interfere with the operation, insertion, or removal of the process element.

Although the inventive, improved process element has been described as using a metal-holding band 6, metal dimpling elements 10 and/or 15, and/or metal cover plates 16 which are preferably connected together as needed by welding, it will be understood that these components can alternatively be formed of other materials and that other methods of bonding or attaching the components of the inventive process element can be used. It will also be understood that other additional features, components, and/or approaches which are sometimes used in wound process elements (e.g., adding spider assembly reinforcements, radially drilling and pinning the wound substrate, mitering the wound substrate to accept metal plates, etc.) can also be used in or added to the inventive process element.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. In a process element including a wound element strip, said wound element strip being wound in a circular pattern and having an outer perimeter, and a holding band having a substantially cylindrical inner surface which is secured around and in contact with said outer perimeter of said wound element strip, the improvement comprising at least one dimpling element positioned and squeezed between said substantially cylindrical inner surface of said holding band and said wound element strip at a dimpling location in a manner effective such that an arched dimple, induced by said dimpling element, is formed in a portion of said outer perimeter of said wound element strip at said dimpling location and wherein, except for said portion of said outer perimeter in which said arched dimple is formed, said outer perimeter of said wound element strip remains in contact with said substantially cylindrical inner surface of said holding band.

2. The process element of claim 1 wherein the improvement further comprises said dimpling element being attached to said holding band.

3. The process element of claim 1 wherein the improvement further comprises at least one cover plate positioned on an end of said dimpling element in a manner effective to substantially prevent flow from occurring through one or more gaps formed by said dimpling element between said holding band and said wound element strip.

4. The process element of claim 3 wherein the improvement further comprises said cover plate being attached to said holding band.

5. The process element of claim 3 wherein the improvement further comprises said cover plate being attached to said end of said dimpling element.

6. The process element of claim 1 wherein the improvement further comprises said dimpling element being substantially cylindrical.

7. The process element of claim 1 wherein the improvement further comprises said dimpling element having a substantially D-shaped cross-section.

8. The process element of claim 1 wherein the improvement further comprises a plurality of said dimpling elements positioned between said holding band and said wound element strip.

9. The process element of claim 8 wherein the improvement further comprises said dimpling elements being grouped in a substantially triangular pattern.

10. The process element of claim 1 wherein the improvement further comprises:

said process element being a catalytic converter element and said wound element strip being a wound catalyst foil strip.

* * * * *